US009604451B2

(12) United States Patent
Nakamura

(10) Patent No.: US 9,604,451 B2
(45) Date of Patent: Mar. 28, 2017

(54) INKJET PRINTER

(71) Applicant: RISO KAGAKU CORPORATION, Tokyo (JP)

(72) Inventor: Hiroyuki Nakamura, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

(21) Appl. No.: 14/938,232

(22) Filed: Nov. 11, 2015

(65) Prior Publication Data

US 2016/0152024 A1 Jun. 2, 2016

(30) Foreign Application Priority Data

Nov. 27, 2014 (JP) ..... 2014-239950

(51) Int. Cl.

| | |
|---|---|
| ***B41J 29/38*** | (2006.01) |
| ***B41J 29/393*** | (2006.01) |
| ***B41J 2/045*** | (2006.01) |
| ***B41J 2/205*** | (2006.01) |

(52) U.S. Cl.

CPC ..... *B41J 2/04536* (2013.01); *B41J 2/04551* (2013.01); *B41J 2/04586* (2013.01); *B41J 2/04595* (2013.01); *B41J 2/2054* (2013.01)

(58) Field of Classification Search

CPC ..... B41J 29/393; B41J 29/38; B41J 2/2054; B41J 2/04508; B41J 2/0458; B41J 2/04536; B41J 2/04586; B41J 2/04551; B41J 2/04595

USPC ..... 347/11, 12, 14, 15, 19

See application file for complete search history.

(56) References Cited

U.S. PATENT DOCUMENTS

2007/0109583 A1* 5/2007 Yoneoka ..... G06K 15/021 358/1.13
2014/0139852 A1* 5/2014 Yamada ..... G06K 15/02 358/1.9

FOREIGN PATENT DOCUMENTS

| | | | |
|---|---|---|---|
| CN | 1509234 | A | 6/2004 |
| EP | 1088662 | A2 | 4/2001 |
| EP | 1517264 | A2 | 3/2005 |
| JP | 2001-277492 | A | 10/2001 |
| JP | 2009-269313 | | 11/2009 |
| JP | 2010-179565 | A | 8/2010 |
| JP | 2014-100794 | A | 6/2014 |

(Continued)

OTHER PUBLICATIONS

Extended European Search of Report, Apr. 22, 2016; European Patent Application No. 15193148.2 (8 pages).

(Continued)

*Primary Examiner* — Jannelle M Lebron

(74) *Attorney, Agent, or Firm* — Hamre, Schumann, Mueller & Larson, P.C.

(57) ABSTRACT

An inkjet printer includes: an inkjet head configured to eject ink; an image acquirer configured to acquire an image data indicating a number of drops of the ink for each of pixels and to output the acquired image data via a communication line; and a head controller configured to convert the image data received from the image acquirer via the communication line such that, in a pixel for which the number of drops of the ink in the received image data is one or more, the number of drops of the ink is incremented while a number of gradation steps of the received image data is maintained, and to control drive of the inkjet head based on the converted image data.

4 Claims, 5 Drawing Sheets

(56) References Cited

FOREIGN PATENT DOCUMENTS

| | | | |
|---|---|---|---|
| JP | 2014-113754 | A | 6/2014 |
| JP | 2015-016634 | A | 1/2015 |

OTHER PUBLICATIONS

Chinese Office Action, Oct. 27, 2016, Chinese Patent Application No. 201510764800.5 (6 pages).

* cited by examiner

76

| NUMBER OF DROPS | 2bpp FOUR GRADATION STEPS | CONVERSION | 3bpp FOUR GRADATION STEPS |
|---|---|---|---|
| 0 | 00 | → | 000 |
| 1 | 01 | → | – |
| 2 | 10 | → | 010 |
| 3 | 11 | → | 011 |
| 4 | – | → | 100 |

INKJET PRINTER

CROSS REFERENCE TO RELATED APPLICATION

This application is based upon and claims the benefit of priority from the prior Japanese Patent Application No. 2014-239950, filed on Nov. 27, 2014, the entire contents of which are incorporated herein by reference.

BACKGROUND

1. Technical Field

The disclosure relates to an inkjet printer configured to perform printing by ejecting ink from an inkjet head.

2. Related Art

In an inkjet printer described in Japanese Unexamined Patent Application Publication No. 2009-269313, ejecting ink from an inkjet head generates ink mist which is atomized ink. The ink mist contaminates the inside of the printer. Accordingly, it is desirable to reduce the ink mist.

When multiple ink drops are ejected for one pixel, an air flow (self-generated air flow) generated by the flying ink drops and flowing from a nozzle to a sheet is strong, and fine droplets are less likely to scatter. Accordingly, the amount of ink mist generated is relatively small. Meanwhile, when one drop is ejected, the self-generated air flow is weaker than that in the case where multiple drops are ejected, and fine droplets are more likely to scatter. Accordingly, the amount of ink mist tends to be great. Hence, in order to reduce the ink mist, it is effective to perform no ejection of one drop for one pixel.

However, when the ejection of one drop is simply omitted, the number of gradation steps is reduced and print image quality decreases. Meanwhile, when the printing is performed with the number of drops changed such that the ejection of one drop is omitted but the number of gradation steps is maintained, the ink mist can be reduced with the decrease in print image quality suppressed.

Specifically, for example, when there are four levels of 0, 1, 2, and 3 for the number of drops for each pixel in the image data, printing is performed with these four levels changed to four levels of 0, 2, 3, and 4 by incrementing the number of drops of 1 to 3 by one. The ejection of one drop is thereby eliminated with the four gradation steps maintained.

SUMMARY

In the inkjet printer, a head controller configured to drive the inkjet head based on the image data is disposed near the inkjet head. In the inkjet printer, the image data is inputted into the head controller via communication lines formed of wire harnesses and the like.

In the printing in which the number of drops is changed while the number of gradation steps in the original image data is maintained as described above, the number of communication lines or the communication rate sometimes needs to be increased from that in the case where printing is performed based on the original image data.

For example, in the aforementioned specific example, when the levels of the number of drops are the four levels of 0, 1, 2, and 3, the image data is 2-bpp data. Meanwhile, when the levels of the number of drops are changed to the four levels of 0, 2, 3, and 4, the image data is 3-bpp data. In other words, the amount of the image data becomes 1.5 times larger. Accordingly, the number of communication lines or the communication rate needs to be increased.

The increase in the number of communication lines leads to complex wiring. Moreover, the increase in the communication rate leads to restriction that a board suitable for high speed communication must be used as a board of the head controller. Moreover, the increase in the number of communication lines and the increase in the communication rate lead to higher cost.

An object of the disclosure is to provide an inkjet printer capable of reducing ink mist while suppressing a decrease in image quality without increase in the communication rate or increase in the number of communication lines for sending image data to a head controller configured to drive an inkjet head.

An inkjet printer in accordance with some embodiments includes: an inkjet head configured to eject ink; an image acquirer configured to acquire an image data indicating a number of drops of the ink for each of pixels and to output the acquired image data via a communication line; and a head controller configured to convert the image data received from the image acquirer via the communication line such that, in a pixel for which the number of drops of the ink in the received image data is one or more, the number of drops of the ink is incremented while a number of gradation steps of the received image data is maintained, and to control drive of the inkjet head based on the converted image data.

According to the configuration described above, since there is no ejection of one drop for one pixel, ink mist can be reduced. Moreover, since the number of gradation steps is maintained, it is possible to suppress a decrease in print image quality due to reduction in the number of gradation steps. Furthermore, since the head controller converts the image data, there is no need to increase the number of communication lines and increase the communication rate. Hence, it is possible reduce the ink mist while suppressing the decrease in print image quality without increase in the communication rate or increase in the number of the communication lines for sending the image data to the head controller.

The head controller may be configured to count a number of drops ejected by the inkjet head based on the converted image data.

According to the configuration described above, an adding circuit which is required to count the number of ejected drops based on the image data before the conversion and which increments the number of ejected drops by an amount corresponding to the image data conversion is unnecessary, and an increase in a circuit scale can be avoided.

The inkjet printer may further include the communication line.

The communication line may include a wire harness.

DETAILED DESCRIPTION

Figure 1:
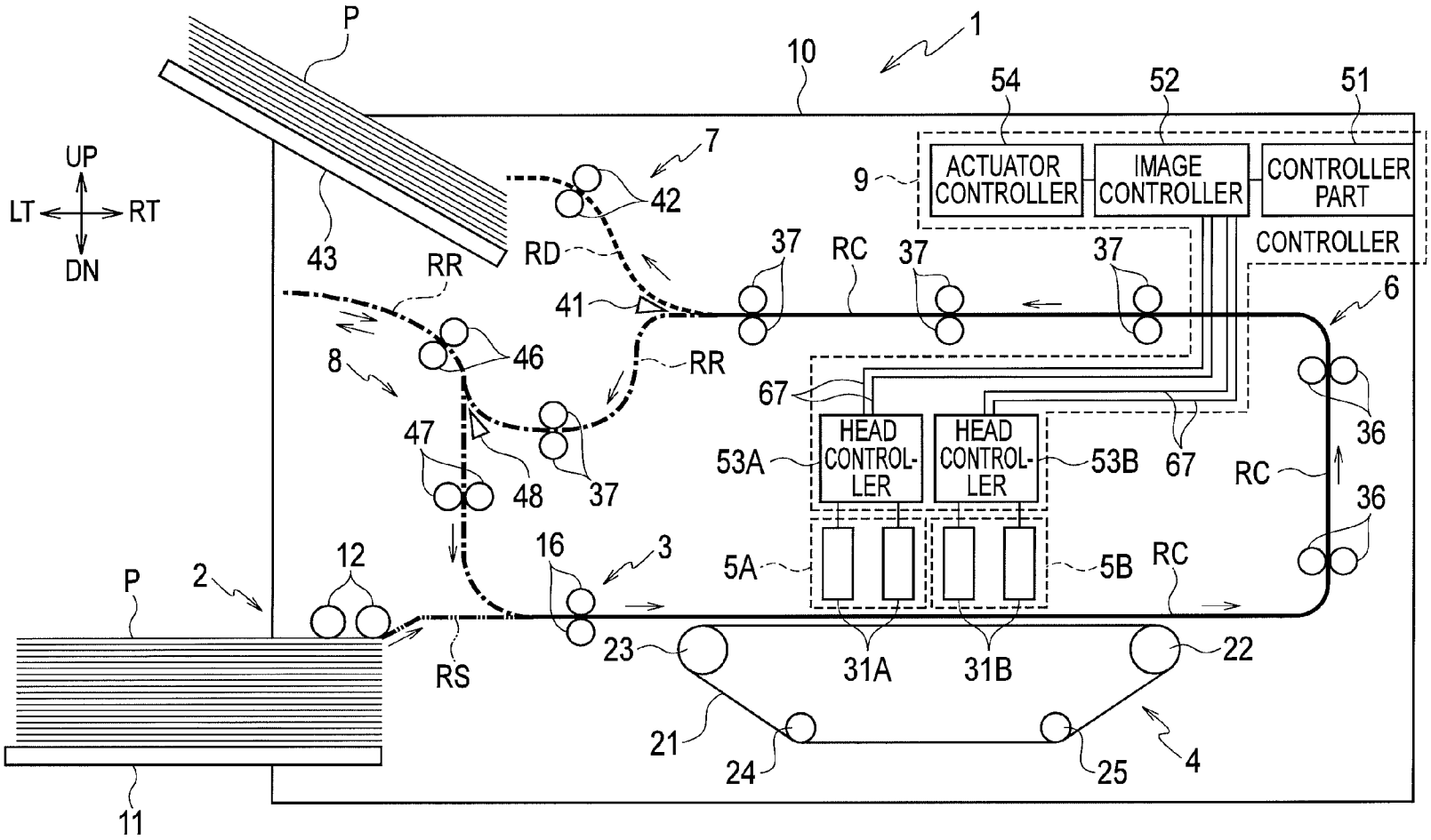
FIG. 1 is a schematic configuration diagram of an inkjet printer in an embodiment.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Description will be hereinbelow provided for embodiments of the present invention by referring to the drawings. It should be noted that the same or similar parts and components throughout the drawings will be denoted by the same or similar reference signs, and that descriptions for such parts and components will be omitted or simplified. In addition, it should be noted that the drawings are schematic and therefore different from the actual ones.

Figure 2:
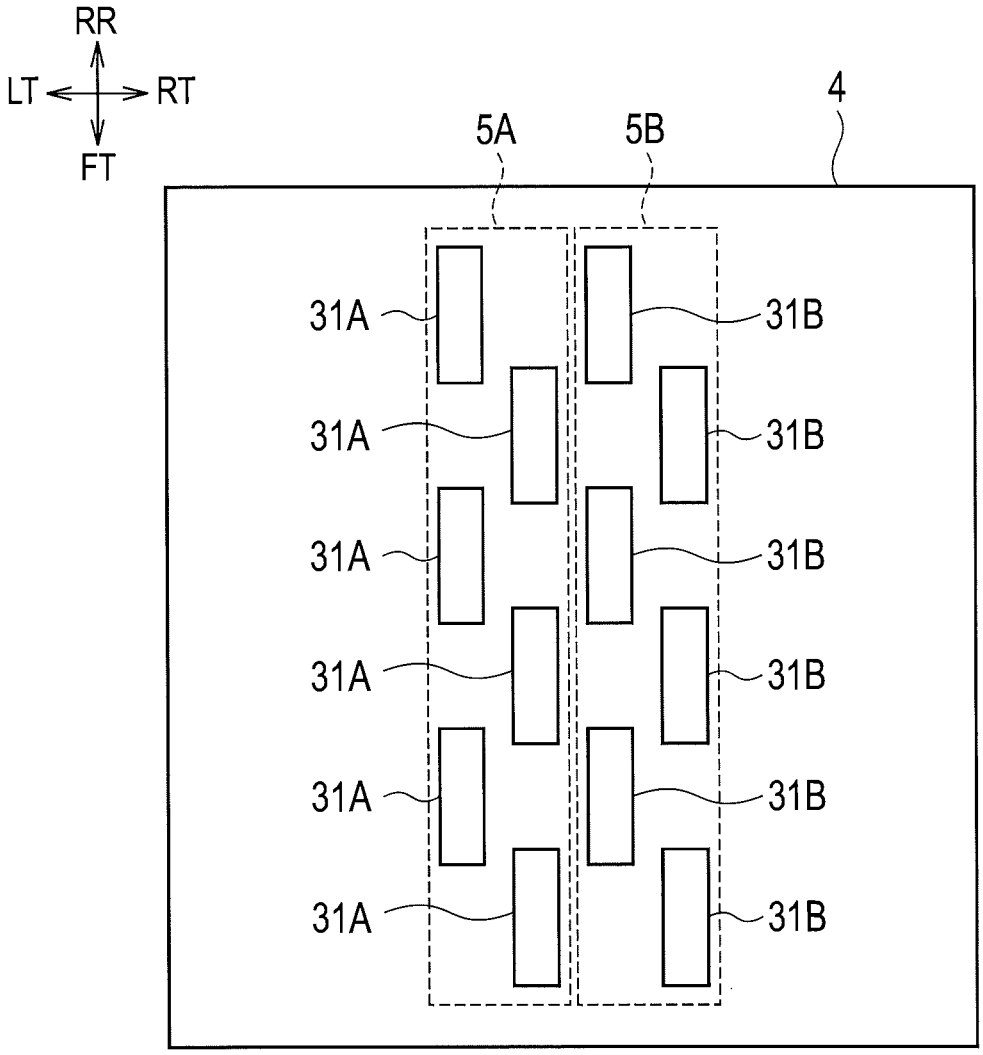
FIG. 2 is a plan view of inkjet heads in the embodiment.
Figure 3:
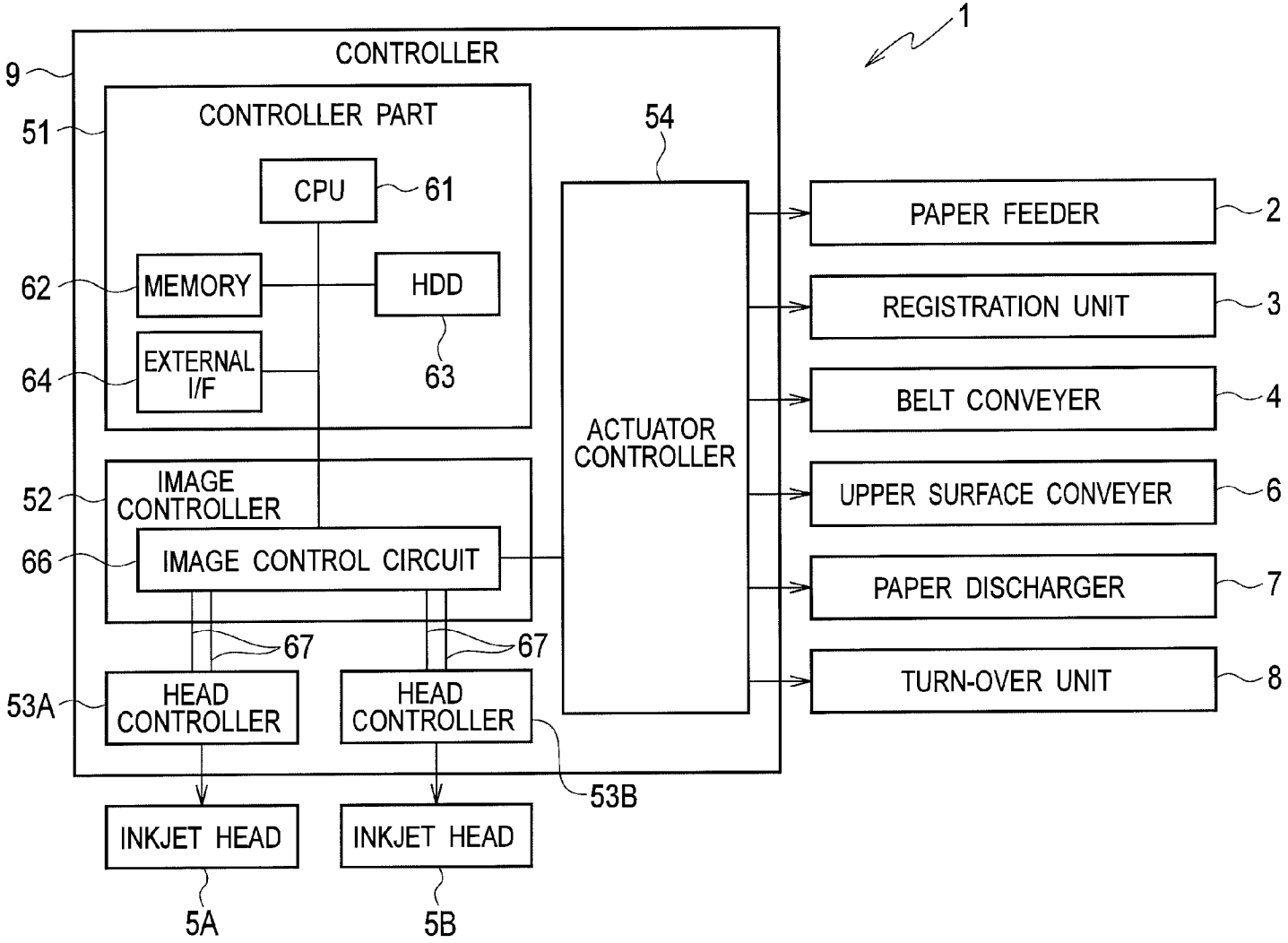
FIG. 3 is a control block diagram of the inkjet printer illustrated in FIG. 1.
Figures 4, 5:
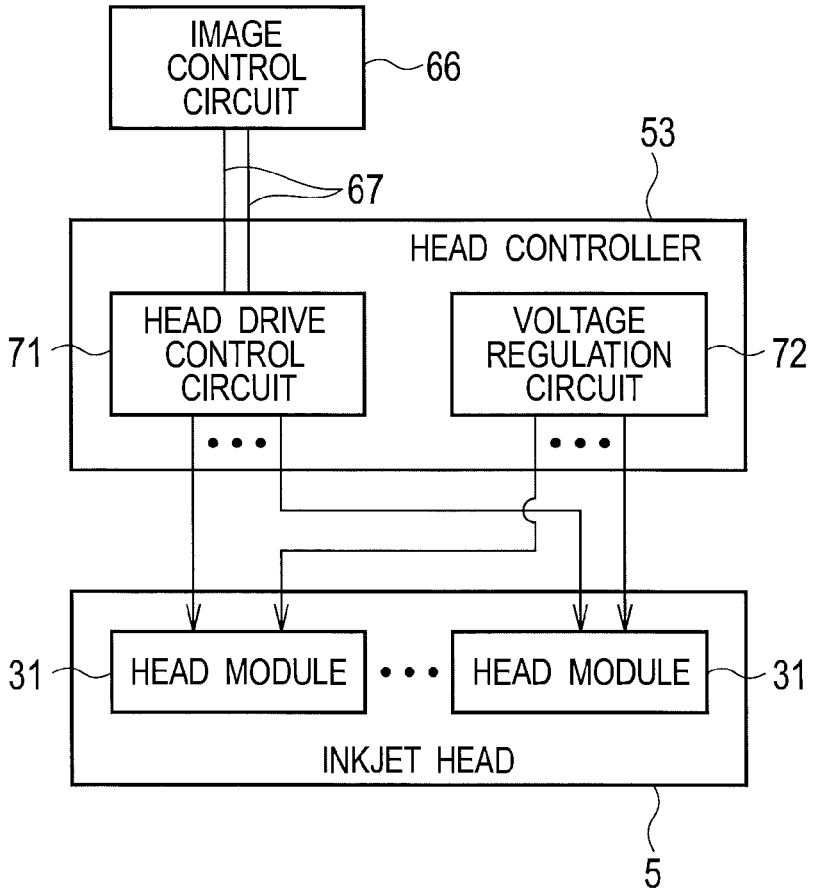
FIG. 4 is a block diagram illustrating a configuration of a head controller in the embodiment.
FIG. 5 is a view showing a conversion table in the embodiment.

FIG. 1 is a schematic configuration diagram of an inkjet printer in an embodiment. FIG. 2 is a plan view of an inkjet head. FIG. 3 is a control block diagram of the inkjet printer illustrated in FIG. 1. FIG. 4 is a block diagram illustrating a configuration of a head controller. In the following description, directions orthogonal to the sheet surface of FIG. 1 are referred to as front-rear directions, and a direction toward the front side of the sheet is referred to as front. Moreover, in FIGS. 1 and 2, directions of right, left, up, down, front, and rear are denoted by RT, LT, UP, DN, FT, and RR, respectively.

A route illustrated by bold lines in FIG. 1 is a conveying route through which sheets being print media are conveyed. In the conveying route, a route illustrated by a solid line is a common route RC, a route illustrated by a one-dot chain line is a turn-over route RR, a route illustrated by a broken line is a paper discharging route RD, and a route illustrated by a two-dot chain line is a paper feeding route RS. In the following description, upstream and downstream mean upstream and downstream in the conveying route.

As illustrated in FIG. 1, the inkjet printer 1 of the embodiment includes a paper feeder 2, a registration unit 3, a belt conveyer 4, inkjet heads 5A and 5B, an upper surface conveyer 6, a paper discharger 7, a turn-over unit 8, a controller 9, and a case 10 housing or holding the aforementioned units.

The paper feeder 2 feeds the sheets P. The paper feeder 2 is disposed upstream of all the other units in the conveying route. The paper feeder 2 includes a paper feed tray 11, paper feeding rollers 12, and a motor (not illustrated) configured to drive the paper feeding rollers 12

The paper feed tray 11 is a tray on which the sheets P used for printing are stacked. Part of the paper feed tray 11 is installed to be exposed to the outside of the case 10.

The paper feeding rollers 12 pick up the sheets P in the paper feed tray 11 one by one, and convey the sheets P along the paper feeding route RS toward registration rollers 16 to be described later. The paper feeding rollers 12 are driven by a not-illustrated motor.

The registration unit 3 conveys each of the sheets P conveyed from the paper feeder 2 or the turn-over unit 8 to the belt conveyer 4. The registration unit 3 includes the registration rollers 16 and a motor (not illustrated) configured to drive the registration rollers 16.

The registration rollers 16 temporarily stop the sheet P conveyed from the paper feeder 2 or the turn-over unit 8 to perform skewing correction and then send out the sheet P toward the belt conveyer 4. The registration rollers 16 are disposed in the common route RC near a point where the paper feeding route RS and the turn-over route RR merge.

The belt conveyer 4 conveys the sheet P conveyed by the registration rollers 16 while sucking and holding the sheet P. The belt conveyer 4 is disposed downstream of the registration rollers 16. The belt conveyer 4 includes a conveyer belt 21, a drive roller 22, driven rollers 23, 24, and 25, and a motor (not illustrated) configured to drive the drive roller 22.

The conveyer belt 21 conveys the sheet P while sucking and holding the sheet P. The conveyer belt 21 is an annular belt wound around the drive roller 22 and the driven rollers 23 to 25. Many belt holes for sucking and holding the sheet P are formed in the conveyer belt 21. The conveyer belt 21 sucks and holds the sheet P on the top surface by using suction force generated at the belt holes by drive of a fan (not illustrated). The conveyer belt 21 conveys the sucked and held sheet P rightward by rotating clockwise in FIG. 1.

The drive roller 22 supports the conveyer belt 21 together with the driven rollers 23 to 25 and rotates the conveyer belt 21.

The driven rollers 23 to 25 support the conveyer belt 21 together with the drive roller 22. The driven rollers 23 to 25 are driven by the drive roller 22 via the conveyer belt 21. The drive roller 23 is disposed on the left side of the drive roller 22 at the same height. The driven rollers 24 and 25 are disposed at the same height, below the drive roller 22 and the driven roller 23, away from each other in a left-right direction.

The inkjet heads 5A and 5B eject inks to the sheet P conveyed by the belt conveyer 4 to print an image. The inkjet heads 5A and 5B each eject two colors of inks. Specifically, the inkjet head 5A ejects a black (K) ink and a cyan ink (C). The inkjet head 5B ejects a magenta ink (M) and a yellow ink (Y). The inkjet heads 5A and 5B are disposed above the belt conveyer 4.

The inkjet head 5A has multiple head modules 31A and the inkjet head 5B has multiple head modules 31B. In the embodiment, as illustrated in FIG. 2, the inkjet head 5A has six head modules 31A and the inkjet head 5B has six head modules 31B.

Note that alphabets (A and B) attached to the reference numerals of the inkjet heads 5A and 5B and the head modules 31A and 31B are sometimes omitted to generally refer to the inkjet heads 5A and 5B and the head modules 31A and 31B.

Each of the head modules 31 has two rows of nozzle arrays (not illustrated). Each of the nozzle arrays are formed of multiple nozzles (not illustrated) arranged in the front-rear directions (main scanning direction). Each of the head modules 31A has a nozzle array including nozzles for ejecting the black ink and a nozzle array including nozzles for ejecting the cyan ink. Each of the head modules 31B has a nozzle array including nozzles for ejecting the magenta ink and a nozzle array including nozzles for ejecting the yellow ink.

In each of the inkjet heads 5, the six head modules 31 are arranged in zigzag in the front-rear directions (main scanning direction). Specifically, the six head modules 31 are arranged in the front-rear directions with the positions thereof being alternately offset in the left-right direction. The head modules 31 are arranged such that the head modules 31 adjacent to each other in the front-rear directions partially overlap each other.

The upper surface conveyer 6 conveys the sheet P conveyed from the belt conveyer 4 to the paper discharger 7 or the turn-over unit 8. The upper surface conveyer 6 includes multiple pairs of upward conveying rollers 36, multiple pairs of horizontal conveying rollers 37, a motor (not illustrated) configured to drive the upward conveying rollers 36, and a motor (not illustrated) configured to drive the horizontal conveying rollers 37.

The upward conveying rollers 36 convey the sheet P conveyed by the belt conveyer 4, to the horizontal conveying rollers 37 thereabove. The upward conveying rollers 36 are disposed in an upward conveying portion in a midstream section of the common route RC.

The horizontal conveying rollers 37 convey the sheet P conveyed by the upward conveying rollers 36, to the paper discharger 7 or the turn-over unit 8. The most downstream pair of horizontal conveying rollers 37 is disposed in an upstream section of the turn-over route RR. The other horizontal conveying rollers 37 are disposed in a horizontal portion in a downstream section of the common route RC.

The paper discharger 7 discharges the printed sheet P. The paper discharger 7 includes a switching part 41, paper discharging rollers 42, a paper receiving tray 43, a solenoid (not illustrated) configured to drive the switching part 41, and a motor (not illustrated) configured to drive the paper discharging rollers 42.

The switching part 41 switches the conveying route of the sheet P from the paper discharging route RD to the turn-over route RR and vice versa. The switching part 41 is disposed at a branching point between the paper discharging route RD and the turn-over route RR.

The paper discharging rollers 42 convey the sheet P guided to the paper discharging route RD by the switching part 41 and discharge the sheet P to the paper receiving tray 43. The paper discharging rollers 42 are disposed in the paper discharging route RD between the switching part 41 and the paper receiving tray 43.

The paper receiving tray 43 is a tray on which the discharged sheets P are stacked. The paper receiving tray 43 is disposed at a downstream end of the paper discharging route RD.

The turn-over unit 8 turns over the sheet P printed on one side and conveys the sheet P to the registration rollers 16 in duplex printing. The turn-over unit 8 includes turn-over rollers 46, paper refeeding rollers 47, a switching gate 48, a motor (not illustrated) configured to drive the turn-over rollers 46, and a motor (not illustrated) configured to drive the paper refeeding rollers 47.

The turn-over rollers 46 switch back the sheet P conveyed by the horizontal conveying rollers 37 and convey the sheet P to the paper refeeding rollers 47. The turn-over rollers 46 are disposed downstream of the most downstream pair of horizontal conveying rollers 37, in the turn-over route RR.

The paper refeeding rollers 47 convey the sheet P switched back and turned over by the turn-over rollers 46, to the registration rollers 16. The paper refeeding rollers 47 are disposed in the turn-over route RR between the pair of turn-over rollers 46 and the pair of registration rollers 16.

The switching gate 48 guides the sheet P conveyed by the horizontal conveying rollers 37, to the turn-over rollers 46. The switching gate 48 also guides the sheet P switched back by the turn-over rollers 46 to the paper refeeding rollers 47 . The switching gate 48 is disposed near a center of mass of three portions of the most downstream pair of horizontal conveying rollers 37, the pair of turn-over rollers 46, and the pair of paper refeeding rollers 47.

The controller 9 controls operations of the entire inkjet printer 1. As illustrated in FIGS. 1 and 3, the controller 9 includes a controller part 51, an image controller 52, head controllers 53A and 53B, and an actuator controller 54. Note that the controller part 51 and the image controller 52 form an image acquirer.

The controller part 51 receives a print job from an external personal computer and decompresses compressed image data included in the print job. Image data of each color is thereby acquired. The image data of each color is data indicating the number of drops of each color of ink for each pixel. In the embodiment, the image data acquired by the controller part 51 is 2-bpp (four gradation step) data, and the number of drops for each pixel is one of four levels of 0, 1, 2 and 3.

The controller part 51 includes a central processing unit (CPU) 61, a memory 62, a hard disk drive (HDD) 63, and an external interface (I/F) 64.

The CPU 61 executes arithmetic processing. The memory 62 temporarily stores data or is used as a work area for the CPU 61 in the arithmetic processing. The HDD 63 stores various types of programs and the like.

The external I/F 64 exchanges data with an external device via a network. The external I/F 64 is formed of a LAN port and the like. The external I/F 64 is installed in an opening portion provided in the case 10 for external connection. Accordingly, the controller part 51 is arranged along an inner surface of the case 10.

The image controller 52 includes an image control circuit 66. The image control circuit 66 divides the image data of each color into pieces of image data for the respective head modules 31. The image control circuit 66 outputs the pieces of image data for the respective head modules 31 to the head controllers 53A and 53B via communication lines 67.

The image control circuit 66 is connected to each of the head controllers 53A and 53B via two communication lines 67. The communication lines 67 are formed of wire harnesses, for example. In the embodiment, the image data is transferred from the image control circuit 66 to the head controllers 53A and 53B at a communication rate of 50 MHz. The image data is thus transferred from the image control circuit 66 to the head controllers 53A and 53B at a bandwidth of 100 Mbps.

The image control circuit 66 is disposed near the controller part 51. Aboard on which the image control circuit 66 is formed may be different from or the same as a board on which the controller part 51 is formed.

The head controllers 53A and 53B control drive of the inkjet heads 5A and 5B, respectively. The head controllers 53A and 53B are disposed near the inkjet heads 5A and 5B. Note that the alphabets (A and B) attached to the reference numerals of the head controllers 53A and 53B are sometimes omitted to generally refer to the head controllers 53A and 53B.

As illustrated in FIG. 4, each of the head controllers 53 include a head drive control circuit 71 and a voltage regulation circuit 72.

When a print mode is a standard mode, the head drive control circuit 71 converts the image data received from the image control circuit 66 via the communication lines 67 such that, in each of pixels for which the number of drops is one or more, the number of drops is incremented while the number of gradation steps is maintained, and controls drive of the corresponding inkjet head 5 based on the converted image data. When the print mode is a high definition mode, the head drive control circuit 71 does not convert the image data and controls the drive of the inkjet head 5 based on the received image data.

The standard mode is a mode in which ejection of one drop of ink for one pixel is not performed. In the standard mode, generation of ink mist is reduced by not performing the ejection of one drop of ink.

The high definition mode is a mode in which the ejection of one drop of ink for one pixel is performed. In the high definition mode, a print image with a higher definition than that in the standard mode can be acquired by performing the ejection of one drop of ink.

The head drive control circuit 71 holds a conversion table 76 illustrated in FIG. 5. The conversion table 76 is a table showing correspondence relationships between the image data before the conversion and the image data after the conversion in the standard mode. The head drive control circuit 71 converts the image data with reference to the conversion table 76 in the standard mode.

As illustrated in FIG. 5, one to three drops are incremented by one and changed to two to four drops in the image data conversion in the standard mode. Zero drops are not changed. The number of gradation steps after the image data conversion is maintained at four which is the same as that before the conversion. However, the image data after the conversion is 3-bpp data compared to 2-bpp data before the conversion.

The head drive control circuit 71 counts and adds up the number of drops ejected by each of the head modules 31 in the inkjet head 5. In the standard mode, the head drive control circuit 71 counts the number of ejected drops based on the converted image data. In the high definition mode, the head drive control circuit 71 counts the number of ejected drops based on the unconverted image data. The number of ejected drops is counted to estimate the life of the head modules 31 and estimate the ink consumption amount.

The voltage regulation circuit 72 regulates voltage of an external power supply and supplies drive voltage to the head modules 31 of the corresponding inkjet head 5.

The actuator controller 54 controls the motors in the paper feeder 2, the registration unit 3, the belt conveyer 4, the upper surface conveyer 6, the paper discharger 7, and the turn-over unit 8 such that the sheet P is conveyed. The actuator controller 54 includes a CPU, a memory, a motor driver (none are illustrated), and the like.

Next, a printing operation of the inkjet printer 1 is described.

Figure 6:
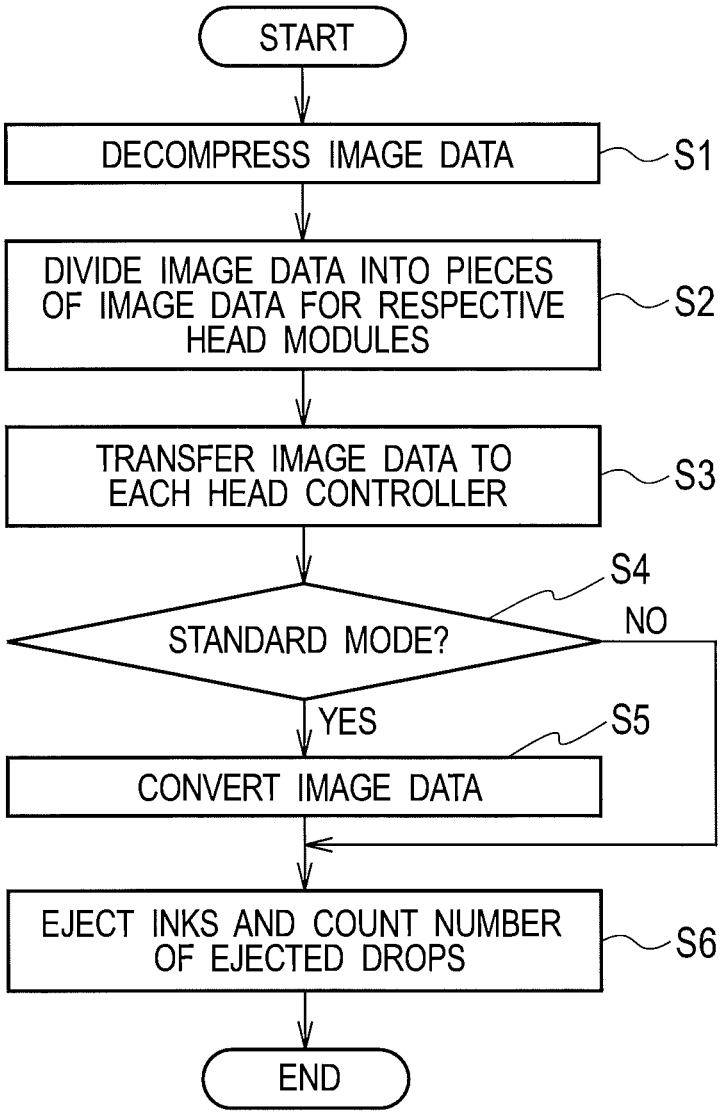
FIG. 6 is a flowchart for explaining a print operation in the embodiment.

FIG. 6 is a flowchart for explaining the printing operation of the inkjet printer 1. The processing in the flowchart of FIG. 6 starts when the controller part 51 receives a print job at the external I/F 64.

In step S1 of FIG. 6, the CPU 61 of the controller part 51 separates the print job into job data and compressed image data and decompresses the compressed image data. Image data for each of colors of black, cyan, magenta, and yellow is thereby acquired. The job data includes information indicating the sheet size, the number of pages to be printed, and the like. The CPU 61 transfers the job data and the image data of each color to the image control circuit 66.

Next, in step S2, the image control circuit 66 divides the image data of each color into pieces of image data for the respective head modules 31. Moreover, the image control circuit 66 performs processing such as seam portion correction on the pieces of image data for the respective head modules 31.

Then, in step S3, the image control circuit 66 transfers the image data to the head drive control circuit 71 of each of the head controllers 53A and 53B via the communication lines 67. As described above, the image data is transferred from the image control circuit 66 to each of the head controllers 53A and 53B at a communication rate of 50 MHz and a bandwidth of 100 Mbps. Moreover, the image control circuit 66 outputs the job data to the actuator controller 54.

Next, in step S4, the head drive control circuit 71 determines whether the instructed print mode is the standard mode. Note that a user can give an instruction to set the print mode to the standard mode or the high definition mode in a printer driver of the personal computer.

When the head drive control circuit 71 determines that the print mode is the standard mode (step S4: YES), the head drive control circuit 71 converts the image data with reference to the conversion table 76 in step S5. The converted image data is 3-bpp data in which the number of drops for each pixel is set to one of the four levels of 0, 2, 3, and 4.

Then, in step S6, the head drive control circuit 71 controls the drive of the head modules 31 of the corresponding inkjet head 5 based on the converted image data and causes the head modules 31 to eject the inks. An image is thereby printed on the sheet P conveyed by the belt conveyer 4. In this case, printing without the ejection of one drop of ink for one pixel is performed. Moreover, the head drive control circuit 71 counts and adds up the number of drops ejected by each of the head modules 31 of the inkjet head 5. A series of operations is thus completed.

When the head drive control circuit 71 determines instep S4 that the print mode is not the standard mode, i.e. is the high definition mode (step S4: NO), the head drive control circuit 71 skips step S5 and proceeds to step S6. Then, in step S6, the head drive control circuit 71 controls the drive of the head modules 31 of the corresponding inkjet head 5 based on the unconverted image data and causes the head modules 31 to eject the inks. An image is thereby printed on the sheet P conveyed by the belt conveyer 4. In this case, printing with the ejection of one drop of ink for one pixel is performed. Moreover, the head drive control circuit 71 counts and adds up the number of drops ejected by each of the head modules 31 of the inkjet head 5. A series of operations is thus completed.

In the printing operation described above, the actuator controller 54 controls the motors in the paper feeder 2, the registration unit 3, the belt conveyer 4, the upper surface conveyer 6, the paper discharger 7, and the turn-over unit 8, based on the job data, such that the sheet P is conveyed.

In the conveying control of the actuator controller 54, the sheet P is first conveyed from the paper feed tray 11 to the registration rollers 16 by the paper feeding rollers 12. The sheet P abuts on the registration rollers 16 to be subjected to skewing correction and then sent out to the belt conveyer 4 by the registration rollers 16. Next, the sheet P is printed by using the inks ejected from the inkjet heads 5A and 5B while being conveyed by the belt conveyer 4. After the printing, the sheet P is conveyed from the belt conveyer 4 to the upper surface conveyer 6 and is conveyed by the upward conveying rollers 36 and the horizontal conveying rollers 37 in the upper surface conveyer 6.

In simplex printing, the sheet P is guided from the common route RC to the paper discharging route RD by the switching part 41 of the paper discharger 7. Then, the sheet P is discharged to the paper receiving tray 43 by the paper discharging rollers 42.

Meanwhile, in duplex printing, the sheet P is guided from the common route RC to the turn-over route RR by the switching part 41. In the turn-over unit 8, the sheet P guided to the turn-over route RR is guided to the turn-over rollers 46 by the switching gate 48 and switched back by the turn-over rollers 46. The switched-back sheet P is guided to the paper refeeding rollers 47 by the switching gate 48. Then, the sheet P is conveyed to the registration rollers 16 by the paper refeeding rollers 47 and conveyed to the belt conveyer 4 by the registration rollers 16.

In this case, since the sheet P is turned over by the turn-over unit 8, an unprinted surface faces upward. The sheet P is printed on the unprinted surface by using the inks ejected from the inkjet heads 5A and 5B while being conveyed by the belt conveyer 4. Then, the sheet P subjected to duplex printing is conveyed to the paper discharger 7 by the upper surface conveyer 6 and discharged to the paper receiving tray 43 in the paper discharger 7.

As described above, in the inkjet printer 1, in the standard mode, each of the head controllers 53 converts the image data received from the image control circuit 66 via the communication lines 67 such that, in each of pixels for which the number of drops is one or more, the number of drops is incremented while the number of gradation steps is maintained. Then, the head controller 53 controls the drive of the corresponding inkjet head 5 based on the converted image data.

Ink mist can be thereby reduced because there is no ejection of one drop for one pixel. Moreover, since the number of gradation steps is maintained, it is possible to suppress a decrease in print image quality due to reduction in the number of gradation steps. Furthermore, since the head controller 53 converts the image data, there is no need to increase the number of the communication lines 67 and increase the communication rate.

Hence, the inkjet printer 1 can reduce ink mist while suppressing the decrease in print image quality without increase in the communication rate or increase in the number of the communication lines 67 for sending the image data to the head controller 53.

When the image data acquired by the controller part 51 is 3-bpp image data in which the number of drops for each pixel is set to one of four levels of 0, 2, 3, and 4 unlike the embodiment, a bandwidth of 150 Mbps is required for the transfer of the image data. Accordingly, three communication lines 67, which is one more than the number of communication lines 67 in the embodiment, are required to transfer the image data to the head drive control circuit 71 at 50 MHz which is the same communication rate as that in the embodiment. Meanwhile, when the number of the communication lines 67 is two which is the same as that in the embodiment, the communication rate needs to be increased to 75 MHz. In other words, in this case, the number of communication lines or the communication rate needs to be increased.

Meanwhile, in the embodiment, the head controller 53 converts the image data. Accordingly, there is no need to increase the number of the communication lines 67 or increase the communication rate as described above.

Moreover, in the inkjet printer 1, the head controller 53 counts the number of the ejected drops based on the converted image data in the standard mode.

When the image controller 52 counts the number of ejected drops unlike the embodiment, the number of ejected drops is counted based on the image data before the conversion. Accordingly, an adding circuit configured to increment the number of ejected drops by an amount corresponding to the image data conversion in the head controller 53 is required.

Meanwhile, in the embodiment, the head controller 53 counts the number of ejected drops based on the converted image data. Accordingly, the aforementioned adding circuit is unnecessary and an increase in a circuit scale can be avoided.

In the embodiment described above, an example is given in which 2-bbp (four gradation step) image data is converted such that the ejection of one drop is eliminated while the number of gradation steps is maintained. However, the number of gradation steps is not limited to four. For example, 3-bpp (eight gradation step) image data may be converted such that the ejection of one drop is eliminated while the number of gradation steps is maintained.

Moreover, although the head controller 53 converts the image data by using the conversion table 76 in the embodiment, the conversion may be performed by using an arithmetic circuit.

Embodiments of the present invention have been described above. However, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

Moreover, the effects described in the embodiments of the present invention are only a list of optimum effects achieved by the present invention. Hence, the effects of the present invention are not limited to those described in the embodiment of the present invention.

What is claimed is:

1. An inkjet printer comprising:

an inkjet head configured to eject ink;

a communication line;

an image acquirer configured to acquire image data indicating a number of drops of the ink for each of pixels and to output the acquired image data via the communication line; and a head controller configured to convert the image data received from the image acquirer via the communication line such that, in a pixel for which the number of drops of the ink in the received image data is one or more, the number of drops of the ink is incremented while a number of gradation steps of the received image data is maintained, and to control drive of the inkjet head based on the converted image data, wherein the image acquirer comprises:

a controller part including a central processing unit, a memory, a hard disk drive, and an external interface, and configured to receive a print job via the external interface and acquire the image data; and an image control circuit configured to output the acquired image data to the head controller via the communication line, the head controller comprises:

a head drive control circuit configured to convert the image data received from the image control circuit via the communication line such that, in the pixel for which the number of drops of the ink in the received image data is one or more, the number of drops of the ink is incremented while the number of gradation steps of the received image data is maintained, and to control drive of the inkjet head based on the converted image data; and a voltage regulation circuit configured to regulate a voltage of an external power supply and supply a drive voltage to the inkjet head, and the communication line connects the image control circuit and the head drive control circuit to each other.

2. The inkjet printer according to claim 1, wherein the head drive control circuit is configured to hold a table showing correspondence relationships between the image data before the conversion and the image data after the conversion and convert the image data with reference to the table.

3. The inkjet printer according to claim 1, wherein the head controller is configured to count a number of drops ejected by the inkjet head based on the converted image data.

4. The inkjet printer according to claim 1, wherein the communication line includes a wire harness.

* * * * *